US007757359B2

(12) United States Patent
Iten

(10) Patent No.: US 7,757,359 B2
(45) Date of Patent: Jul. 20, 2010

(54) BUCKLE MECHANISM

(75) Inventor: Roland Iten, Lausanne (CH)

(73) Assignee: X-Ray Management & Licensing Ltd. (GB)

( * ) Notice: Subject to any disclaimer, the term of this patent is extended or adjusted under 35 U.S.C. 154(b) by 444 days.

(21) Appl. No.: 11/817,272

(22) PCT Filed: Feb. 27, 2006

(86) PCT No.: PCT/IB2006/000394

§ 371 (c)(1),
(2), (4) Date: Aug. 28, 2007

(87) PCT Pub. No.: WO2006/090255

PCT Pub. Date: Aug. 31, 2006

(65) Prior Publication Data

US 2008/0148527 A1 Jun. 26, 2008

(30) Foreign Application Priority Data

Feb. 28, 2005 (EP) ..... 05101510

(51) Int. Cl.
*A44B 11/24* (2006.01)

(52) U.S. Cl. ..... 24/163 R; 24/181; 63/3.1; 2/322

(58) Field of Classification Search ..... None
See application file for complete search history.

(56) References Cited

U.S. PATENT DOCUMENTS 300,215 A * 6/1884 Chase ..... 24/181
301,565 A * 7/1884 Chase ..... 24/181
905,775 A * 12/1908 Warren ..... 24/178
1,511,665 A 10/1924 Faulkner
1,619,138 A * 3/1927 Kollstede ..... 24/180
3,488,814 A 1/1970 Cormier
5,878,466 A 3/1999 Iten et al.
6,393,671 B1 5/2002 Chen

OTHER PUBLICATIONS

International Search Report dated Aug. 4, 2006 for International Application No. PCT/IB2006/000394.

International Preliminary Report on Patentability issued on Sep. 11, 2007 for International Application No. PCT/IB2006/000394.

* cited by examiner

*Primary Examiner*—Jack W. Lavinder
(74) *Attorney, Agent, or Firm*—Galbreath Law Offices, P.C.; John A. Galbreath

(57) ABSTRACT

A buckle mechanism (1), for releasably and adjustably connecting an attachment member (3) to a tongue member (5), comprises a fixed buckle member (2) connected to or adapted for being connected to the attachment member (3). A movable element (4) that is adapted to be connected to the tongue member (5) is slidably mounted inside the fixed buckle member (2) between a first stable position and a second stable position for varying a distance along a pulling direction between said tongue member (5) and said attachment member (3). This mechanism further comprises a manually-operable lever system (6, 6') for moving the movable element (4) between its first and second stable position.

14 Claims, 3 Drawing Sheets

BUCKLE MECHANISM

The present invention concerns a buckle generally for waist belts, said buckle being able to be adapted to pieces of jewelry such as necklaces and bracelets.

Prior art discloses a buckle mechanism that comprises a first buckle member and a second buckle member which are both attached to a lever. Said second buckle member can be tilted and rotated between two stable positions by means of said lever in order to modify the distance between the two ends of the belt. The second buckle member comprises a pin engaging in a hole of the belt's tongue. The disadvantage of such mechanism stems from the fact that the second buckle member being rotatably connected to the first buckle member, the pin must also be mounted so that it can rotate in order to remain engaged in the hole of the belt's tongue during the entire rotation of said second buckle. The longitudinal axis of the pin can thus form an angle with the pulling axis which can be substantially different from 90 degrees. The tongue is thus not correctly engaged, which can damage the hole.

The aim of the present invention is to propose a buckle mechanism containing an element comprising a pin, said element being able to be moved linearly along the pulling axis thus ensuring an angle of 90 degrees between the longitudinal axis of the pin and the pulling axis.

This aim is achieved by a buckle mechanism such as set out in claim 1. Such buckle mechanism, for releasably and adjustably connecting an attachment member to a tongue member, comprises a fixed buckle member connected to or adapted for being connected to the attachment member. A movable element that is adapted to be connected to the tongue member is slidably mounted inside the fixed buckle member between a first stable position and a second stable position for varying a distance along a pulling direction between said tongue member and said attachment member. A manually-operable lever system is actuatable for moving the movable element between its first and second stable position.

The invention will be better understood thanks to the following detailed description of a preferred embodiment with reference to the attached drawings, in which.

Figure 1:
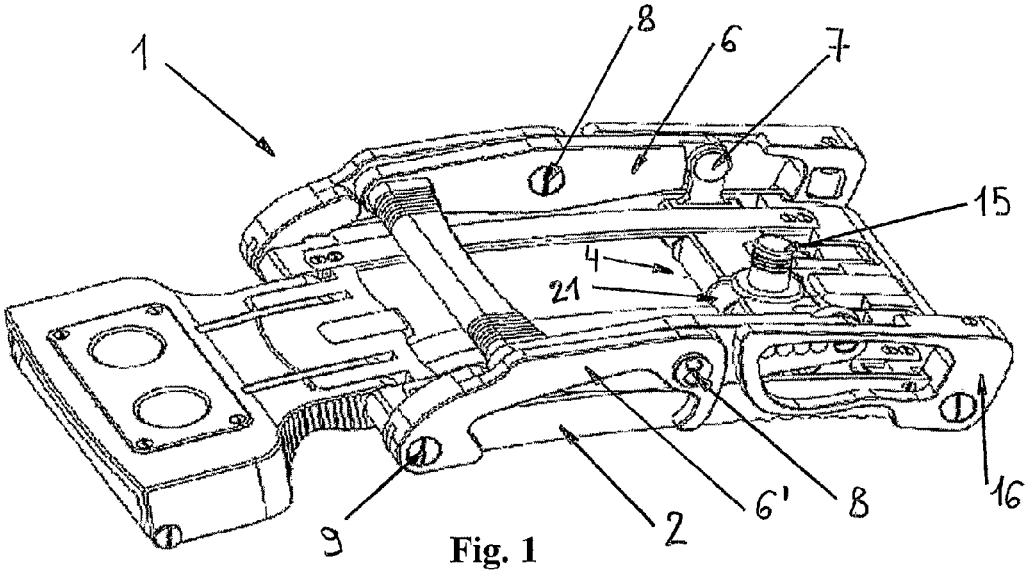
FIG. 1 represents a perspective view of a buckle mechanism.
Figure 2:
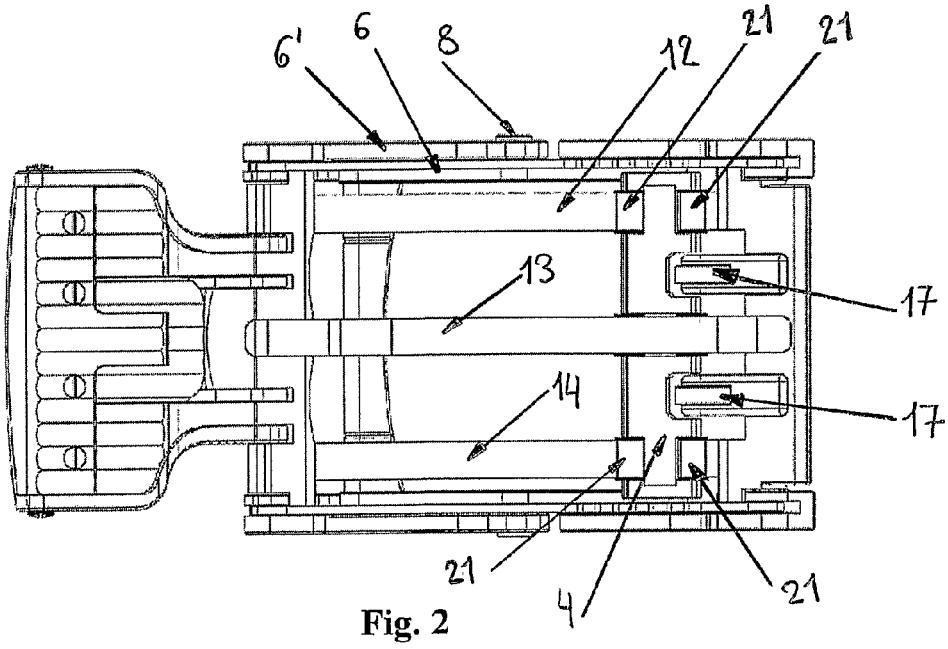
FIG. 2 represents a bottom view of said mechanism.
Figure 3:
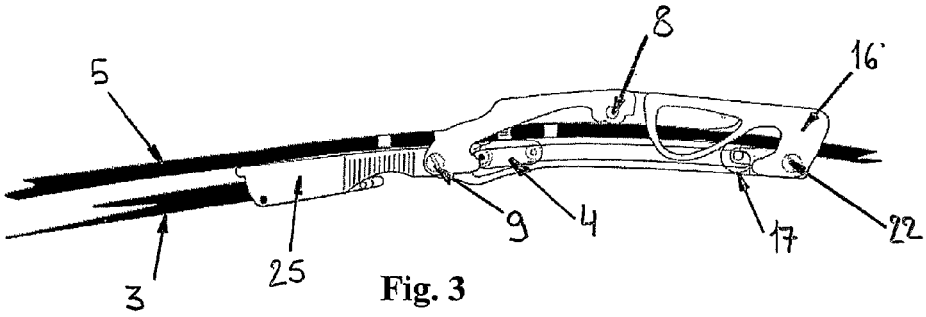
FIG. 3 represents a side view of the buckle mechanism connecting the attachment member to the tongue member, the movable element being in its first stable position and the manually-operable lever system confined inside the fixed buckle member.

According to the preferred embodiment of the invention, the buckle mechanism (1) is made up of the fixed buckle member (2) which comprises the manually-operable lever system (6, 6'), and the movable element (4) slidably connected to said fixed buckle member (2). The latter is adapted to be connected to the attachment member (3) of the belt while the movable element is adapted to be releasably attached to the tongue (5) of the belt.

The movable element (4) has a pin (15) extending perpendicularly to the pulling direction and is adapted to engage in a hole (20) of the belt's tongue (5). The tongue (5) comprises a plurality of holes (20), thus allowing a releasable connection of the tongue (5) with the movable element in a plurality of positions.

The movable element (4) comprises three sets of two rollers (21), one set of rollers (21) being mounted at each side of said element (4) and one set being mounted in its centre. By means of these rollers, the movable element (4) can slide along three rails (12, 13, 14) which are part of the fixed buckle member (2). These rails (12, 13, 14) are assembled parallel to each other along the buckle mechanism's longitudinal direction at constant distance. Both external rails (12, 14) are positioned above two sets of rollers (21) mounted at each side of the element (4) while the middle rail (13) is positioned below the set of rollers (21) mounted in the centre of said element (4). Such assembly permits the movable element (4) to be slidably connected to the fixed buckle member (2) between the first and the second stable position.

When actuated, the manually-operable lever system (6, 6') causes the movable element (4) to slide between its first and second stable position for varying a distance along a pulling direction between said tongue member (5) and said attachment member (3).

Figure 4:
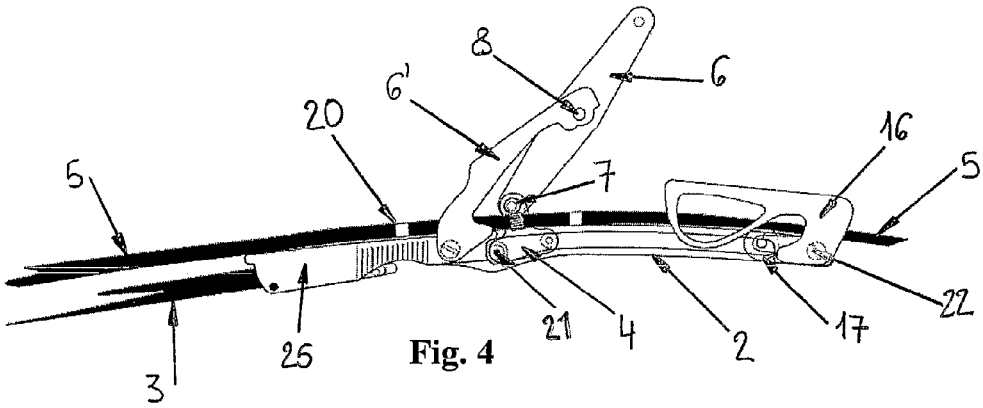
FIG. 4 represents a side view of the buckle mechanism connecting the attachment member to the tongue member when the manually-operable lever system has been tilted to some extent.
Figure 5:
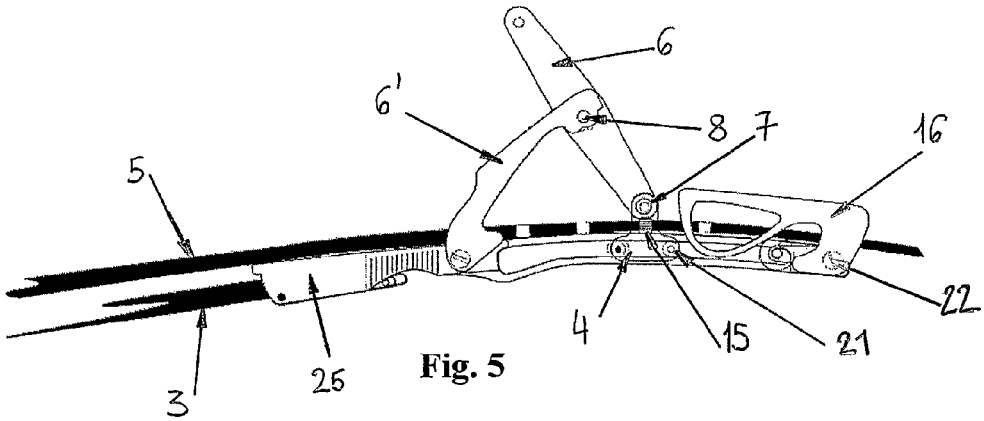
FIG. 5 represents a side view of the buckle mechanism connecting the attachment member to the tongue member when the manually-operable lever system has been further tilted and the movable element is about midway between its first stable position and its second stable position.

The manually-operable lever system comprises a first lever member (6) pivotally connected to the movable element (4) about a first axis (7). As shown in FIGS. 4 and 5, the middle of this first lever member (6) is further pivotally connected to a second lever member (6') about a second axis (8). The second lever member (6') is further pivotally connected to the fixed buckle member (2) about a third axis (9).

Figure 6:
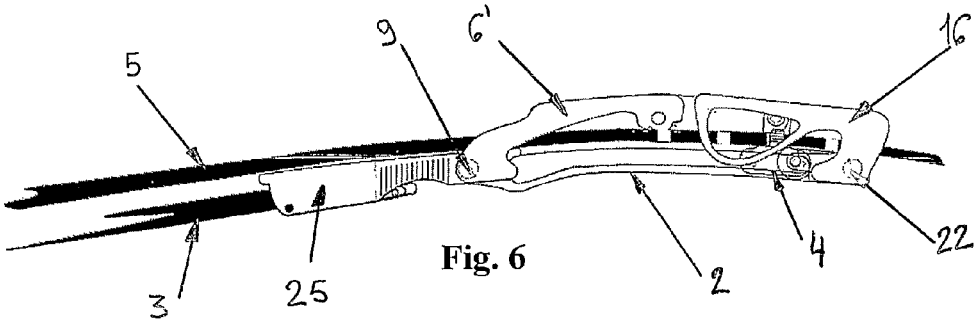
FIG. 6 represents a side view of the buckle mechanism connecting the attachment member to the tongue member when the movable element has been dragged by the manually-operable lever system to its second stable position.
Figure 7:
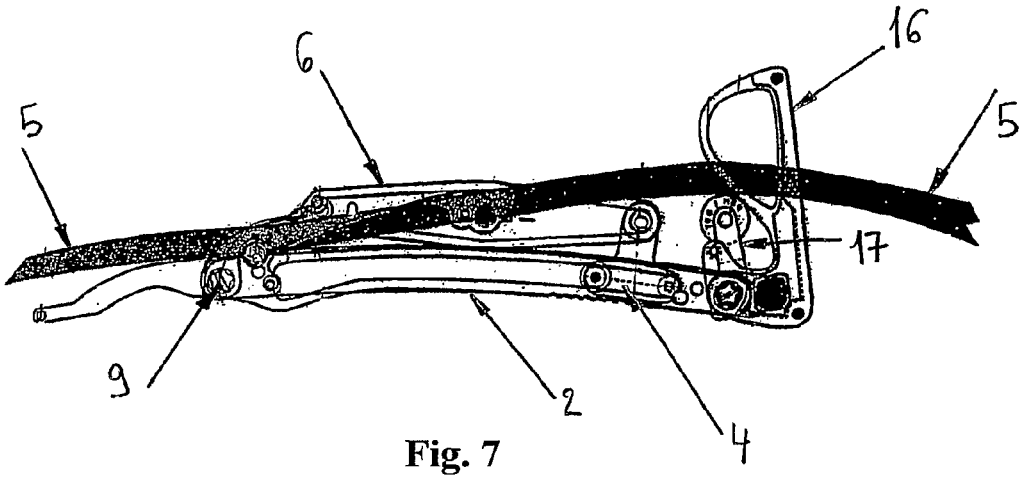
FIG. 7 represents a side view of the buckle mechanism showing a release element for releasing the tongue member from the movable element by disengaging the pin out of the hole in said tongue member.
Figure 8:
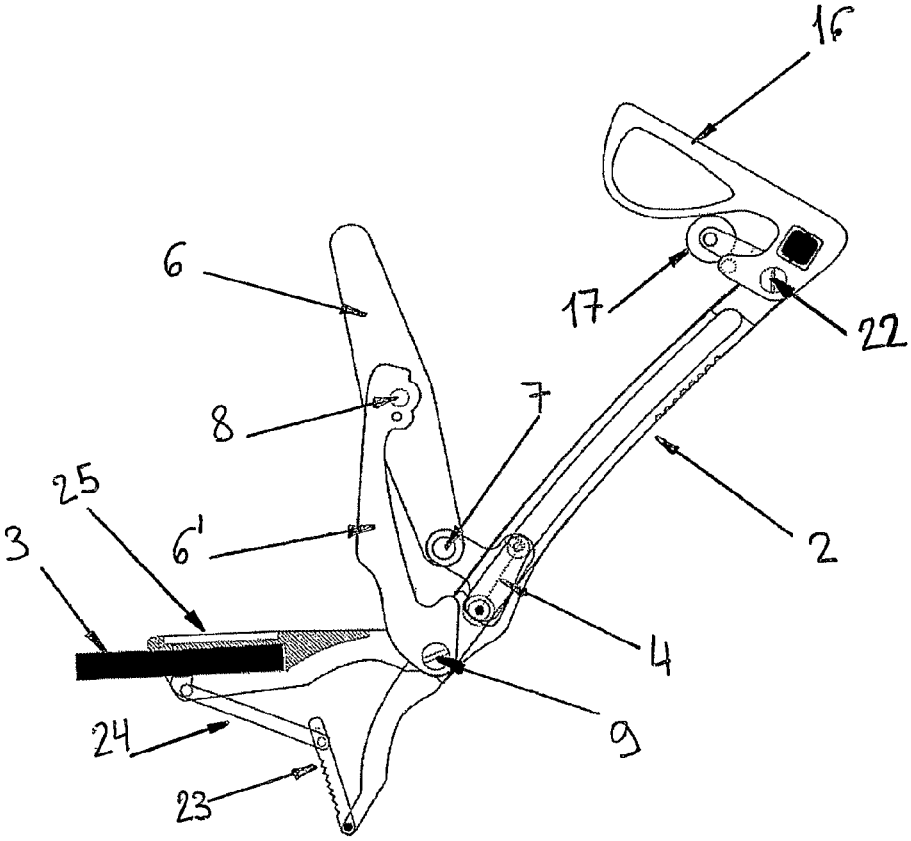
FIG. 8 represents a side view of the buckle mechanism fully deployed comprising jaws for holding the attachment member.

The manually-operable lever system (6, 6') is actuated when the first lever member (6) is tilted. As shown in FIGS. 4 and 5, the movable element (4) is dragged by said lever (6) to slide along the rails (12, 13, 14) between the first stable position and the second sable position. When the first lever (6) is further tilted more than 90 degrees, said lever (6) is pushed against the tongue (5), of the belt bringing the movable element (4) to the second stable position (FIG. 6).

The first and third axes (7, 9) are arranged such that in the two stable positions, a force extending along the pulling direction generates a torque for pushing the manually-operable lever system (6, 6') against the tongue member (5). This prevents undesired tilting of the manually-operable lever system (6, 6').

A release element (16) is pivotally mounted about a fourth axis (22) at one end of the fixed buckle member (2) for releasing, when required, the tongue member (5) from the movable element (4) by disengaging the pin (15) out of the hole in said tongue member (5). This release element (16) comprises at least one pushing element (17) for pushing the tongue member (5) in a direction generally parallel to the longitudinal axis of the pin (15).

The fixed buckle member (2) further comprises first and second jaws (23, 24) for holding the attachment member (3) and a lever (25) pivotally connected to the jaws (23, 24) for closing or opening them.

The described buckle mechanism (1) is suitable for wearing apparel such as trousers but can be used for other applications including jewelry without departing from the scope of the invention as defines in the appended claims.

The invention claimed is:

1. A buckle mechanism for releasably and adjustably connecting an attachment member (3) to a tongue member (5), comprising a fixed buckle member (2) connected to or adapted for being connected to the attachment member (3), a movable element (4) that is adapted to be connected to the tongue member (5) and is slidably mounted inside the fixed buckle member (2) between a first stable position and a second stable position for varying a distance along a pulling direction between said tongue member (5) and said attachment member (3), and a manually-operable lever system (6, 6') for moving the movable element (4) between its first and second stable positions, characterized in that the manually-operable level system (6, 6') comprises an actuating lever (6) that is tiltable through about 180.degree. to move the movable element (4) between its first and second stable positions, and characterized in that the manually-operable lever system comprises a first lever member (6) pivotally connected to the movable element (4) about a first axis (7), said first lever member (6) being further pivotally connected to a second lever member (6') about a second axis (8), the second lever member (6') being pivotally connected to the fixed buckle member (2) about a third axis (9), the movable element (4) being able to slide between the first stable position and the second stable position with tilting of the lever member (6) through approximately 180 degrees by pivoting of the first lever member (6) about said first and second axes (7, 8) while the second lever member (6') pivots about the third axis (9).

2. A buckle mechanism (1) according to claim 1, characterized in that the fixed buckle member (2) comprises rails (12, 13, 14) that support and guide the movable element (4) during movement between from the first stable position and the second stable position.

3. A buckle mechanism (1) according to claim 2, characterized in that the movable element (4) comprises a pin (15) extending perpendicularly to said pulling direction for engaging a hole (20) in the tongue member (5).

4. A buckle mechanism (1) according to claim 2, characterized in that a release element (16) is pivotally mounted at one end of the fixed buckle member (2) for releasing, when required, the tongue member (5) from the movable element (4) by disengaging the pin (15) out of the hole in said tongue member (5).

5. A belt comprising a buckle mechanism as claimed in claim 2.

6. A buckle mechanism (1) according to claim 1, characterized in that the movable element (4) comprises a pin (15) extending perpendicularly to said pulling direction for engaging a hole (20) in the tongue member (5).

7. A buckle mechanism (1) according to claim 1, characterized in that a release element (16) is pivotally mounted at one end of the fixed buckle member (2) for releasing, when required, the tongue member (5) from the movable element (4) by disengaging the pin (15) out of the hole in said tongue member (5).

8. A belt comprising a buckle mechanism as claimed in claim 1.

9. A buckle mechanism (1) for releasably and adjustably connecting an attachment member (3) to a tongue member (5), comprising a fixed buckle member (2) connected to or adapted for being connected to the attachment member (3), a movable element (4) that is adapted to be connected to the tongue member (5) and is slidably mounted inside the fixed buckle member (2) between a first stable position and a second stable position for varying a distance along a pulling direction between said tongue member (5) and said attachment member (3), and a manually-operable lever system (6, 6') for moving the movable element (4) between its first and second stable positions, characterized in that a release element (16) is pivotally mounted at one end of the fixed buckle member (2) for releasing, when required, the tongue member (5) from the movable element (4) by disengaging the pin (15) out of the hole in said tongue member (5).

10. A buckle mechanism (1) according to claim 9, characterized in that said release element (16) comprises at least one pushing element (17) for pushing the tongue member (5) in a direction generally parallel to the longitudinal axis of the pin (15).

11. A bracelet or necklace comprising a buckle mechanism for releasably and adjustably connecting an attachment member (3) to a tongue member (5), comprising a fixed buckle member (2) connected to or adapted for being connected to the attachment member (3), a movable element (4) that is adapted to be connected to the tongue member (5) and is slidably mounted inside the fixed buckle member (2) between a first stable position and a second stable position for varying a distance along a pulling direction between said tongue member (5) and said attachment member (3), and a manually-operable lever system (6, 6') for moving the movable element (4) between its first and second stable positions.

12. A buckle mechanism (1) for releasably and adjustably connecting an attachment member (3) to a tongue member (5), comprising a fixed buckle member (2) connected to or adapted for being connected to the attachment member (3), a movable element (4) that is adapted to be connected to the tongue member 5 and is slidably mounted inside the fixed buckle member (2) between a first stable position and a second stable position for varying a distance along a pulling direction between said tongue member (5) and said attachment member (3), and a manually-operable lever system (6, 6') for moving the movable element (4) between its first and second stable positions, characterized in that the manually-operable level system (6, 6') comprises an actuating lever (6) that is tiltable through about 180.degree. to move the movable element (4) between its first and second stable positions, and characterized in that a release element (16) is pivotally mounted at one end of the fixed buckle member (2) for releasing, when required, the tongue member (5) from the movable element (4) by disengaging the pin (15) out of the hole in said tongue member (5).

13. A buckle mechanism (1) for releasably and adjustably connecting an attachment member (3) to a tongue member (5), comprising a fixed buckle member (2) connected to or adapted for being connected to the attachment member (3), a movable element (4) that is adapted to be connected to the tongue member (5) and is slidably mounted inside the fixed buckle member (2) between a first stable position and a second stable position for varying a distance along a pulling direction between said tongue member (5) and said attachment member (3), and a manually-operable lever system (6, 6') for moving the movable element (4) between its first and second stable positions, characterized in that the movable element (4) comprises a pin (15) extending perpendicularly to said pulling direction for engaging a hole (20) in the tongue member (5), and characterized in that a release element (16) is pivotally mounted at one end of the fixed buckle member (2) for releasing, when required, the tongue member (5) from the movable element (4) by disengaging the pin (15) out of the hole in said tongue member (5).

14. A belt comprising a buckle mechanism for releasably and adjustably connecting an attachment member (3) to a tongue member (5), comprising a fixed buckle member (2) connected to or adapted for being connected to the attachment member (3), a movable element (4) that is adapted to be connected to the tongue member (5) and is slidably mounted inside the fixed buckle member (2) between a first stable position and a second stable position for varying a distance along a pulling direction between said tongue member (5) and said attachment member (3), and a manually-operable lever system (6, 6') for moving the movable element (4) between its first and second stable positions, characterized in that the movable element (4) comprises a pin (15) extending perpendicularly to said pulling direction for engaging a hole (20) in the tongue member (5).

* * * * *